US006014789A

United States Patent [19]

Knapp

[11] Patent Number: 6,014,789

[45] Date of Patent: Jan. 18, 2000

[54] MULTIPLE TUBE CLEANING PIG FEATURING REPLACEABLE DISKS ANCHORING CLEANING STUDS

[76] Inventor: Kenneth M. Knapp, 4018 W. Main, Houston, Tex. 77027

[21] Appl. No.: 09/018,000

[22] Filed: Feb. 3, 1998

[51] Int. Cl.[7] ..... B08B 9/04

[52] U.S. Cl. ..... 15/104.063; 15/104.061

[58] Field of Search ..... 15/3.5, 104.061, 15/104.062, 104.063, 104.05, 104.16, 104.2

[56] References Cited

U.S. PATENT DOCUMENTS 3,673,629 7/1972 Casey et al. .
4,244,073 1/1981 Sagawa .
4,767,603 8/1988 Byrd et al. .
4,907,314 3/1990 Kershaw .
5,035,021 7/1991 Le Devehat .
5,150,493 9/1992 Sivacoe .
5,265,302 11/1993 Sivacoe .
5,400,456 3/1995 Skibowski .

*Primary Examiner*—Robert J. Warden, Sr.
*Assistant Examiner*—Jennifer C. McNeil
*Attorney, Agent, or Firm*—Gunn & Associates, P.C.

[57] ABSTRACT

The present disclosure is directed to a pig for cleaning thin wall tubes in a heat exchanger which are subjected to internal deposits which become very hard with heating during use. The pig comprises an elongate central mandrel between front and back end pieces and supports a structurally defined carefully positioned disk. The disk in turn has a plurality of radially directed tapped holes evenly spaced therearound and the holes enable threading of a set of headed bolts in them. The length of the bolts is precisely controlled so that the outer exposed tip of the bolt head contacts the tube to scratch the interior to break the hard deposits without denting the surrounding tube.

14 Claims, 1 Drawing Sheet

FIG. 1
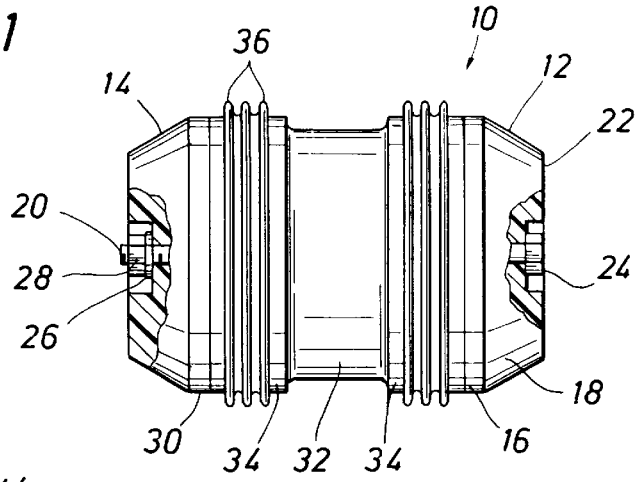
FIG. 2
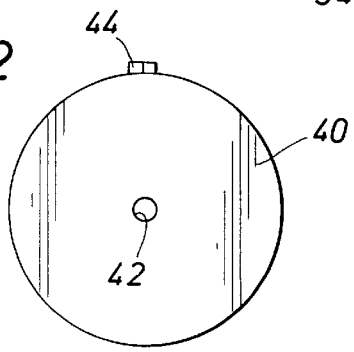
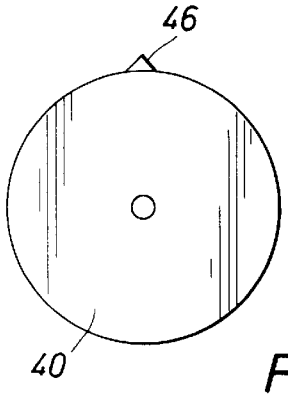
FIG. 3
FIG. 4
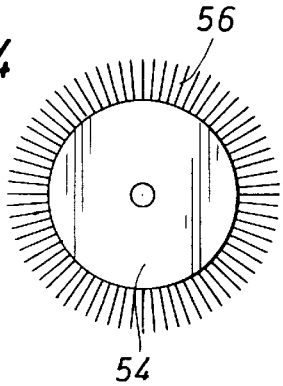
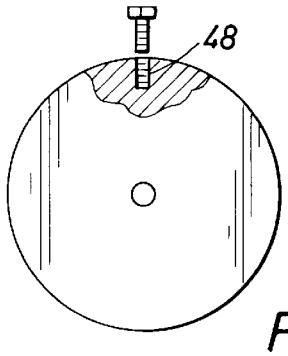
FIG. 5
FIG. 6
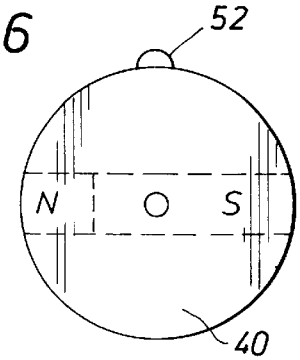
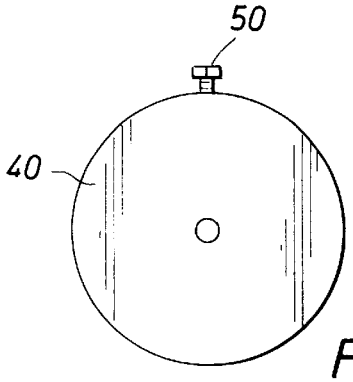
FIG. 7

MULTIPLE TUBE CLEANING PIG FEATURING REPLACEABLE DISKS ANCHORING CLEANING STUDS

BACKGROUND OF THE DISCLOSURE

This disclosure is directed to the problem of cleaning a nest of heat exchanger tubes. Heat exchangers are normally formed in a nest or bundle of many straight parallel pipes or tubes. They typically are not very long and not very large. They are used in transferring heat from a heated fluid to another fluid, and most often are found in petrochemical complexes. It is not uncommon to install a heat exchanger with a furnace to heat water so that steam can be formed. In heating water, minerals in the water plate on the inside surfaces of the heat exchanger tubes. This forms various carbonate deposits. Even where the water is purified significantly in advance, some carbonates and other deposits are formed. To the extent that other minerals are found in the feed, different deposits may be placed in the inside wall but they accumulate and form a serious problem. The same problem arises where petroleum fractions in fluids are heated. Heavier molecules will plate or coat the inside surface of the tubes. Over time with the constant exposure to heat, the materials can become relatively hard. On the scale of hardness, they can exceed that of typical carbonates. For instance, where the fluid heated is water, the water will deposit minerals to form a deposit which has the hardness approximately of sheet rock or comparable materials. If it becomes even harder over time, hence more coking, it can become as hard as concrete. On the scale of hardness using diamond as a 10.0 maximum value, it is not uncommon to build heat exchanger tube deposits which have a hardness of 5 to 7 mohs. This creates a serious problem because it reduces the capacity of the heat exchanger tubes. With a tube having a radius of precisely 1.000 inches. A deposit of 0.01 inches does not seem like an overwhelming problem. When the deposit becomes 0.02 inches, it still seems relatively trivial, that nevertheless represent a 4% loss in effective cross-sectional area. With a deposit twice as thick, the loss is 12%. As one will see, this is a substantial reduction in flow cross-sectional area.

Tube cleaning in a heat exchanger is periodically required. There is however a balance which can be determined for the frequency of tube cleaning. Tube cleaning normally involves letting the deposits build to such a point that the loss of efficiency is substantial. In a heat exchanger, the loss of efficiency may not be solely from the loss of cross-sectional area suggested by the arithmetic noted above. Rather, the problem may be compounded by the insulative nature of the deposits. Especially when they begin coking, they become a hard ceramic which is slightly porous. It may well serve as a thermal barrier in the heat exchanger tubes and reduce the effective heat transfer rate through the wall between the two fluids. As the heat transfer becomes less efficient, greater heat levels are required. This may harden the deposits to an even greater level. In that instance, the BTU consumption rate for the furnace or boiler is much higher so the furnace or boiler is then taken out of service, the tubes are cleaned and it is restored to service. In effect, the cost of utilities increase steadily with accumulated deposits, and can become sufficient that cleaning is mandated at a cost of interrupting the process.

A plant shutdown is an expensive undertaking. It is not so much the cost of the cleaning service that is costly; the problem derives from the loss of production. It is not uncommon for a single boiler to require cleaning yet the plant itself may produce a revenue stream of several million dollars per day. When the plant is out of service for two or three days for repairs, the cost savings in reduced utilities may seem great, but it is relatively minor in comparison with the loss of production. By balancing this, plant shutdowns are timely implemented.

Consider now the benefits of cleaning the heat exchanger tubes. Typically they are small, up to about 5 or 6 inches in maximum diameter. Most heat exchanger tubes are in the range of about 1 or 2 inches. Assume that the deposits have been hardened with temperature to about 5 or 6 mohs hardness over time. The present disclosure sets forth a cleaning device which can be used at elevated temperatures. The exterior of the heat exchanger may be exposed to the updraft of a furnace. The interior of the tubes is exposed to the steam, heated water or other fluid receiving the heat transfer. In that region, it is possible to install pig launching apparatus which will position a pig in line for transfer through a tube of the furnace heat exchanger. The heat exchanger in that region however is operated at an elevated temperature. The actual temperature depends on the nature of the process, but using conversion of water into steam as an example, the system is able to clean the tubes dynamically during operation. For specified temperature ranges, typically up to about 500° F., the present apparatus sets forth a pig for dynamic cleaning. The furnace and heat exchanger have to be taken out of service to enable cleaning when the materials of the equipment cannot tolerate the elevated temperatures. The present disclosure sets out a polyurethane based multiple component pig assembly which is anchored on a central bolt serving as a mounting mandrel.

It is possible to make a cast polyurethane or other elastomer body having metal studs extending from the side which scratch, scrape or otherwise break up deposits, especially those that have been converted into coke like substances and at 5 or 6 on the hardness scale. It is however difficult to get dimensional stability and a firm anchor by attachment of a bolt in a polyurethane foam body. The dimensional stability is in part dependent on the density of the foam. If the foam is light weight, there is an inherent lack of structural stability. Light weight foam is preferred because it reduces the cost of the pig. A heavy foam is not desirable because the cost goes up, and yet dimensional stability is improved only slightly. If a stud is mounted entirely through a pig body, it can be stable and position the tip precisely but that requires a relatively large diameter body to anchor the stud. For instance, a pig of 12 to 24 inches diameter will support and accurately position a set of studs. In that arrangement, the studs are mounted so that the tip cuts to the right depth and is controlled in relative location. Pigs of that size cannot be used in cleaning small diameter tubes in heat exchangers. The present disclosure is directed to a pig which uses an insertable steel disk. The steel disk is carefully drilled at selected locations, and threaded bolts are anchored around the periphery thereby defining a carefully positioned set of studs for contact against the wall of the heat exchanger. Precise positioning is relatively important. If the pig is placed in a heat exchanger tube having an ID of 4.000 inches, it is desirable that the stud head protrude to that length but not further. Precise positioning is necessary to break up the scale. If for instance a stud does not penetrate the scale, then there will be no scale removal. On the other hand, if the stud is too long, it may gouge and scar the thin wall heat exchanger tube. Positioning of that precision requires lateral support for each stud so they do not wobble or bind.

The present disclosure is directed to a multiple part pig for heat exchangers. It is constructed so that the pig body assembles and disassembles. The pig is assembled so that it supports a selected number of flat steel disks of specified thickness. Around the outside, they have a number of calculated openings which mount a set of threaded studs. The drilled and tapped openings enable positioning of the studs at a selected cylindrical position around the centerline axis, thereby sharply cutting the scale in a heat exchanger without damaging the heat exchanger. This enables a set of disks to be interchanged thereby putting longer studs on the pig for wiping the tubing. This enables progressive breakage of the scale deposits on the interior of the heat exchanger tubes. The pig operates bidirectionally and is symmetrical comparing the two ends. The pig construction utilizes a skin covered polyurethane body. The body parts are coated at the surface or skin to assure that the components are able to exclude penetration or absorption of organic materials.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

FIG. 1 is a side view of the tube cleaning pit of the present disclosure showing multiple components threaded on a mandrel; and FIGS. 2 through 7 show different sizes and forms of disks supported in the pig of FIG. 1.

DETAILED DESCRIPTION OF THE PREFERRED EMBODIMENT

Attention is first directed to FIG. 1 of the drawings where the pig of the present disclosure is shown in FIG. 1 and incorporates a nose portion 12 along with a similar tail portion 14 which are identical in construction. They both include a cylindrical portion at the body end, and a tapered conic section. The cylindrical portion 16 is built integrally with the tapered conic portion 18. The conic portion terminates at an exposed face 22. Along the centerline axis, there is a passage through the elastomer, rubber or solid plastic member to support a threaded shaft 20 which extends the length of the pig body. The shaft 20 is part of a bolt having a head 24 at one end and is threaded to receive a washer 26 and nut 28 at the opposite end. This enables the nut to be threaded on the shaft to pull the components together. With appropriate tightening, a compressive load is placed on the components to squeeze them together. The end portions have the exposed tapered face which extends towards the end face 22. Ideally, at one or both ends, there is a recess or cavity. The cavity is recessed to provide room for the bolt head or nut at the opposite end. The bolt assembly compressively loads the conic end portions. Through the use of appropriate flat washers, the tension applied to the components can be controlled to assure locking all the parts together.

The two conic end members are identical. They have an external diameter 30 which will be discussed in relation to the tubes to be cleaned. The conic portion extending to the end face 22 tapers at about a 15 to about 30° angle. The tapered end streamlines the assembled cleaning device 10 for easy entry into the tubes of the heat exchanger. The resilient materials forming the end portions are integrally constructed.

The body is shaped with the receptacle at the nose end to receive either the head on the bolt or the nut at the opposite end. This assures that a seating area is provided so that hand tool engagement snugs up the bolt and pulls it tight. Moreover, the bolt head butting against the receptacle distributes a compressive load in the polyurethane components. The two end pieces therefore are compressively loaded. They clamp against the intermediate pieces as will be described.

Attention is now directed to a central spacer 32 which is an elongate right cylinder formed of cast elastomer or rubber. Moreover, it has a central axial passage through it. The central passage is sized to receive the bolt which holds the several components sandwiched together. The central passage is along the centerline axis of the cylinder. The end faces are parallel and define faces which abut two or more disks inserted at end locations. The disks 34 are clamped between the center spacer 32 and the two end pieces. If desired, the spacer 32 can be omitted leaving only one or more disks 34 clamped between the end pieces 12 and 14. By omission, some benefit is gained in the sense that the device is shortened. When shorter, it enables turning in a shorter radius of curvature. When longer, it enables more surface agitation against the wall of the tubing being cleaned.

A wiping disk 34 is shown at two locations in FIG. 1. In both instances, it is a disk having two or more sealing ribs 36. The ribs 36 have the appearance of an inverted V which is formed of flexible material. The disk 34 is preferably formed of a cast elastomer. This again defines a cast component in the same fashion as the other components. The mold shapes the ribs 36 around the disk. The ribs 36 taper to a point at the other edge. They are flexible to the touch. They are bent to and fro, and flex with bending. Therefore, they are included to completely fill the gap between the pig 10 and the surrounding wall. This enables a wiping action to be accomplished.

The wiping action resultant from the ribs 36 depends on the flexibility of the ribs. They are not stiff, but they are flexible to provide the appropriate sealing action between the pig and the surrounding tube. The disks 34 are completely free of tight dimensional requirements. Such requirements are reduced when merely attempting to seal in a tube. The opposite however is noted with the disk shown in FIGS. 2–7 which are interchangeable with disks 34 shown in FIG. 1. The disk 40 shown in FIG. 2 is preferably formed of steel. The central hole 42 fits snugly around the bolt 20 threaded through the pig. This prevents wobble or canting of the disk 40 when installed. FIG. 3 shows a similar disk 40. The disks in FIGS. 2 and 3 differ in the stud which is mounted on them. FIG. 2 shows the studs 44 about the disk 40, while the other drawings illustrate only a single stud, several studs are installed preferably evenly around the outer face or periphery of the disk 40. While FIG. 2 shows a flat headed stud 44, FIG. 3 shows a pointed stud head 46. More will be noted regarding the studs. Attention is now directed to FIG. 5 of the drawings where the disk is partly broken away to show a drilled and tapped opening 48. By careful machining to thereby control the depth of the tapped hole 48. the depth of the hole is controlled so the position of the head of the stud is controlled. Contrast, the height of the head 44 shown in FIG. 2 with the head 50 shown in FIG. 7. For purposes of illustration, the head 50 is much taller. It extends radially outwardly to a greater distance. Moreover, it is constructed so that the top face of the stud head 50 is registered at a particular radial spacing with respect to the centerline axis of the disk 40; since that is controlled, the several studs deployed around the disk define a cylindrical surface around the centerline axis which limits the cutting or chiseling limits of the several studs. By controlling the multiple studs and the points on them, precise dimensional control is obtained. This dimensional control is important for sharply scratching without damaging the surrounding tube.

The tubes in the bundle are relatively thin. They are not like pipe in a pipeline. They are relatively short and are dimensionally stable. Moreover, they are typically precisely parallel and are deployed between two or more transverse sheets which hold the tubes parallel. They are normally installed with precise dimensional positioning with almost no load placed on them in a structural sense. While a heat exchanger in a boiler may be at a high elevated absolute pressure of hundreds or several thousand psi, the pressure across the tubes is generally controlled. From the inside to the outside of an individual tube, the pressure differential is normally limited. There is therefore little stress on the tubes and there is little need for heavy duty walls. So to speak, the wall of the heat exchanger tube is generally described as sheet metal in contrast with the heavy duty walls of pipes. Cleaning pigs are used in pipelines. A 6 inch diameter pipeline has a wall thickness of perhaps ¼ inch or so. The thickness can be greater or less dependent on the pressure rating of the pipeline. However, pipelines are normally rated for a significant pressure differentials. Even with low level pressures maintained in municipal water work system of perhaps only 30 psi head, pipes still have substantial wall thickness for dimensional stability when buried. The overfill in a trench tends to crush a pipe. Accordingly, the context in which the device 10 of this invention is used is significantly different. As stated above, careful dimensional control is accomplished by controlling the depth of the tapped opening 48 and the length of the stud which is mounted in it.

The disk 40 is drilled with a specified number of trapped openings 48. For example, 24 tapped openings arranged the circle mount 24 studs. They are all tapped to a specified depth. Threading of the studs is carefully controlled so that the outer tips carefully contact the surrounding pipe.

FIG. 6 shows another form which in this instance is a round head 52. Cumulatively, a set of rounded heads enablers the several studs to cut deposits in the tubing without forming a sharp groove or indention into the tube.

FIG. 4 of the drawings shows a smaller diameter disk 54 equipped with bristles 56 defining a brush. The bristles are stiff and extend radially outwardly and are slightly longer than the diameter of the tube. While wire bristles are relatively stiff, they have a tendency to scratch. The preferred form of bristles is stiff nylon bristles. They tend to wear away slightly and can become somewhat polished in use. Whether new or polished after substantial use, relatively stiff nylon bristles are preferred because they treat the tube surface better over time. The bristles abrade the deposits in the tube.

Certain dimensional aspects of the tube cleaning pig should be noted. As a generalization, it is never made larger than about 5 inches, and 6 inches is established as the maximum diameter. Tubes of heat exchangers are in the area of 2 or 3 inches in diameter. There is no benefit to heat exchanger tubes larger than about 6 inches. Accordingly, the present pit is limited to about 6 inches in diameter. In additional, the end pieces must have a taper of at least about 15°. This enables the pig to make contact with control mechanisms which sort pigs, and otherwise contact them in pig launchers. The pig length is limited to about 150% of the tube diameter. While longer pigs can be made and can be especially beneficial in short straight tubes in a heat exchanger, longer pigs have a difficult time turning. Many heat exchangers are built with U-shaped ends outside the sheets at one or both ends of the heat exchanger tubes. These require cleaning also. The radius of curvature limits the length of the pig as stated to about 150% of the diameter. The pigs of the present disclosure sometimes must be located. To this end, the disk 40 shown in FIG. 6 is modified. The disk is readily made of stainless steel which is a non magnetic material. The disk receives an embedded bar magnet having north and south poles as marked. This helps locate the pig from the exterior with a magnetically responsive pig passage indicator. Such devices are readily available from a number of vendors. Also, magnets can be cast in the spool 32.

The pig of the present disclosure can be assembled. It has advantages over the pig set forth in U.S. Pat. No. 5,035,021. That pig shows an embedded bolt. It is taken apart with greater difficulty. Disassembly is an advantage in that changes can be implemented by changing the disk. One or more new disks can be inserted and the old disk is removed or supplemented. Stacking several disks is generally not encouraged because it makes the pig longer than desired. As noted, pig length is limited so that the radius of curvature on turning can be tolerated. In another aspect, the referenced patent is somewhat deficient in that the cleaning action by a sacrificial resilient ring or scraper is somewhat limited. For soft deposits, practically any shape of pig lip or scraper will suffice. In a heat exchanger, deposits which are initially soft ultimately become much harder when they are chemically converted by the continuous heat to form hard deposits. Indeed, they can have the hardness of fired ceramics such as tile or brick. They form a ceramic insulator that is not wanted at that particular location. When they become about 6 mohs, then it becomes important to use the metal disk of this disclosure featuring several precisely controlled studs to precisely position metal points for chiseling the deposits. This kind of precision requires structural rigidity in the system. That is provided by the embodiment disclosed presently and is significantly an advance over the pig set forth in U.S. Pat. No. 5,035,021.

While the foregoing is directed to the preferred embodiment, the scope thereof is determined by the claims which follow.

I claim:

1. A pig for cleaning heat exchanger tubes formed of thin wall tubes subject to coating on the inside wherein the coating over time becomes harder to the range of at least about 4 mohs, a heat exchanger tube cleaning pig comprising:

(a) front and back end pieces supported on a lengthwise mandrel, wherein said front and back end pieces each comprises cylindrical section and a conic section;

(b) a dimensionally stable interchangeable disk between the end pieces of the pig, wherein truncated ends of said conic sections of said front and back pieces face in opposite directions and away from said disk; and (c) a plurality of precisely positioned mounting studs on said disk wherein each of said studs has an outer end and said outer ends collectively define a concentric radial edge about the centerline axis of the pig precisely located for cleaning the deposits in the tube.

2. The apparatus of claim 1 wherein said disk supports a plurality of studs at a set of mounting holes and said studs are precisely mounted with controlled threaded connections.

3. The apparatus of claim 2 wherein said studs comprise threaded bolts mounted in drilled and tapped openings in said disk extending radially therefrom and having a specified length.

4. The pig of claim 3 wherein said bolts have deposit breaking heads.

5. The pig of claim 4 wherein said bolt heads are metal and have points.

6. The pig of claim 3 wherein said pig has a length of 150% or less than a diameter of said radial edge.

7. The pig of claim 6 wherein diameter is limited to about 6 inches.

8. The pig of claim 7 wherein said front and back end pieces are symmetrical.

9. The pig of claim 8 wherein said mandrel includes an elongate bolt with head and nut to compressively lock said end pieces.

10. The pig of claim 9 wherein said elongate bolt fits in mounting recesses on said end pieces.

11. The pig of claim 10 wherein said end pieces are formed of cast elastomer or rubber.

12. The pig of claim 11 wherein the pig end pieces telescope on the mandrel and said disk is clamped therebetween.

13. The pig of claim 1 further including a second circular concentric disk supporting a stiff plastic bristle set extending radially outwardly therefrom and wherein bristles in said set decrease in length due to wear during cleaning with said pig.

14. The pig of claim 1 wherein said disk supports a magnet to form a magnetic field cooperative with a pig passage indicator.

* * * * *